United States Patent [19]

Fukumoto

[11] Patent Number: 5,002,322

[45] Date of Patent: Mar. 26, 1991

[54] LID LOCKING DEVICE

[75] Inventor: Ryoichi Fukumoto, Nagoya, Japan

[73] Assignee: Aisin Seiki Kabushiki Kaisha, Kariya, Japan

[21] Appl. No.: 412,002

[22] Filed: Sep. 25, 1989

[30] Foreign Application Priority Data

Sep. 30, 1988 [JP] Japan ..... 63-248477

[51] Int. Cl.[5] ..... E05B 15/02

[52] U.S. Cl. ..... 292/341.16; 292/142; 292/172; 292/201; 70/279

[58] Field of Search ..... 70/240, 241, 244, 158–162, 70/277; 292/142, 144, 172, 176, 201, 216, 341.14–341.16, DIG. 11

[56] References Cited

U.S. PATENT DOCUMENTS

| | | | |
|---|---|---|---|
| 2,491,791 | 12/1949 | Allen | 70/158 |
| 3,759,075 | 9/1973 | Lipschutz | 70/159 |
| 3,854,310 | 12/1974 | Paull et al. | 70/279 X |
| 3,930,388 | 1/1976 | Barras | 70/159 |
| 4,030,322 | 6/1977 | Pettit | 70/159 |
| 4,290,634 | 9/1981 | Gelhard | 292/201 |
| 4,518,179 | 5/1985 | Fenner | 292/201 X |
| 4,583,381 | 4/1986 | Sjogren | 292/142 X |
| 4,702,117 | 10/1987 | Tsutsumi et al. | 292/172 X |
| 4,796,932 | 1/1989 | Tame | 292/341.16 X |

*Primary Examiner*—Robert L. Wolfe
*Assistant Examiner*—Suzanne L. Dino
*Attorney, Agent, or Firm*—Burns, Doane, Swecker & Mathis

[57] ABSTRACT

A lid locking device for a vehicle has a pawl attached to the lid and engaged by a retractable plunger. The plunger is retracted by contacting a projection of a rotatable worm-wheel to permit opening of the lid. The worm-wheel is rotated into position by a worm gear mounted on a rotating shaft. The worm-wheel and plunger are returned to their original positions by the release of energy stored in springs during the retraction of the plunger.

14 Claims, 5 Drawing Sheets

LID LOCKING DEVICE

BACKGROUND OF THE INVENTION

1. Field of the Invention

The present invention relates to a lid locking device, and more specifically, to a device for locking a lid which opens pivotally.

2. Description of the Related Art

Vehicle bodies are generally provided with an opening through which the end of a nozzle is passed for supplying a fuel, such as gasoline, to the fuel tank. The lid which covers this opening is pivotally attached to the body and held closed by the engagement of an integrally formed pawl and a solenoid driven plunger inside the body. For refueling operations, the plunger is disengaged from the pawl and the lid is allowed to swing away from the body.

However, inadvertently disengaging the plunger before unlocking the lid causes a loud and unpleasant noise. Additionally, since the solenoid is relatively large, it is difficult to install inside the body of the vehicle.

SUMMARY OF THE INVENTION

The primary objective of the present invention is to provide a lid locking device without these drawbacks. Another objective of this invention is to provide a lid locking device in which the lid and plunger are mechanically engaged without using a solenoid.

To achieve these objectives, the present lid locking device includes a lid with a pawl, pivotally mounted on a body in order to cover an opening, a base member attached to the body and having a guide portion, and a plunger supported by the guide portion so as to be movable in the axial direction in order to engage the pawl. A first spring urges the plunger towards the pawl. The device also includes a motor that has a shaft provided with worm type gearing. A rotatably mounted worm-wheel is provided at a peripheral portion of the shaft. The worm-wheel has a plurality of teeth that mesh with the worm gear in such a manner that rotational movement is transmitted from the worm to the worm-wheel and vice versa. A projection projects from the worm-wheel so as to make contact with another projection which projects from the plunger when the worm-wheel is rotated. A second spring means returns the worm-wheel to its original position upon completion of its rotation and disengagement of the plunger from the pawl.

BRIEF DESCRIPTION OF THE DRAWINGS

These and other objectives, features, and benefits of the present invention will become apparent from the following drawings and detailed description of the preferred embodiment of the present invention.

DETAILED DESCRIPTION OF A PREFERRED EMBODIMENT

Figure 1:
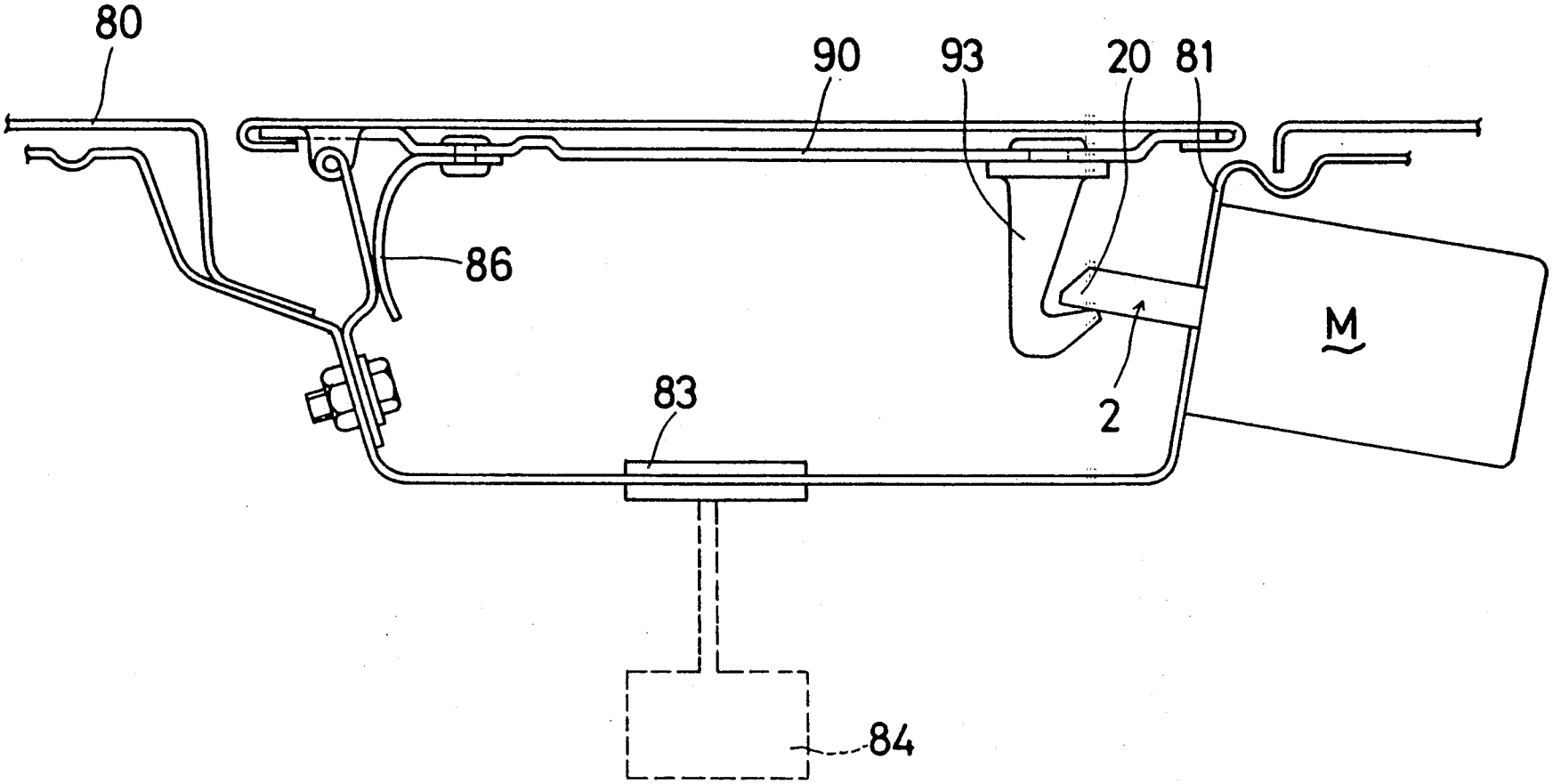
FIG. 1 is a schematic illustration of the lid locking arrangement according to one embodiment of the present invention.
Figure 2:
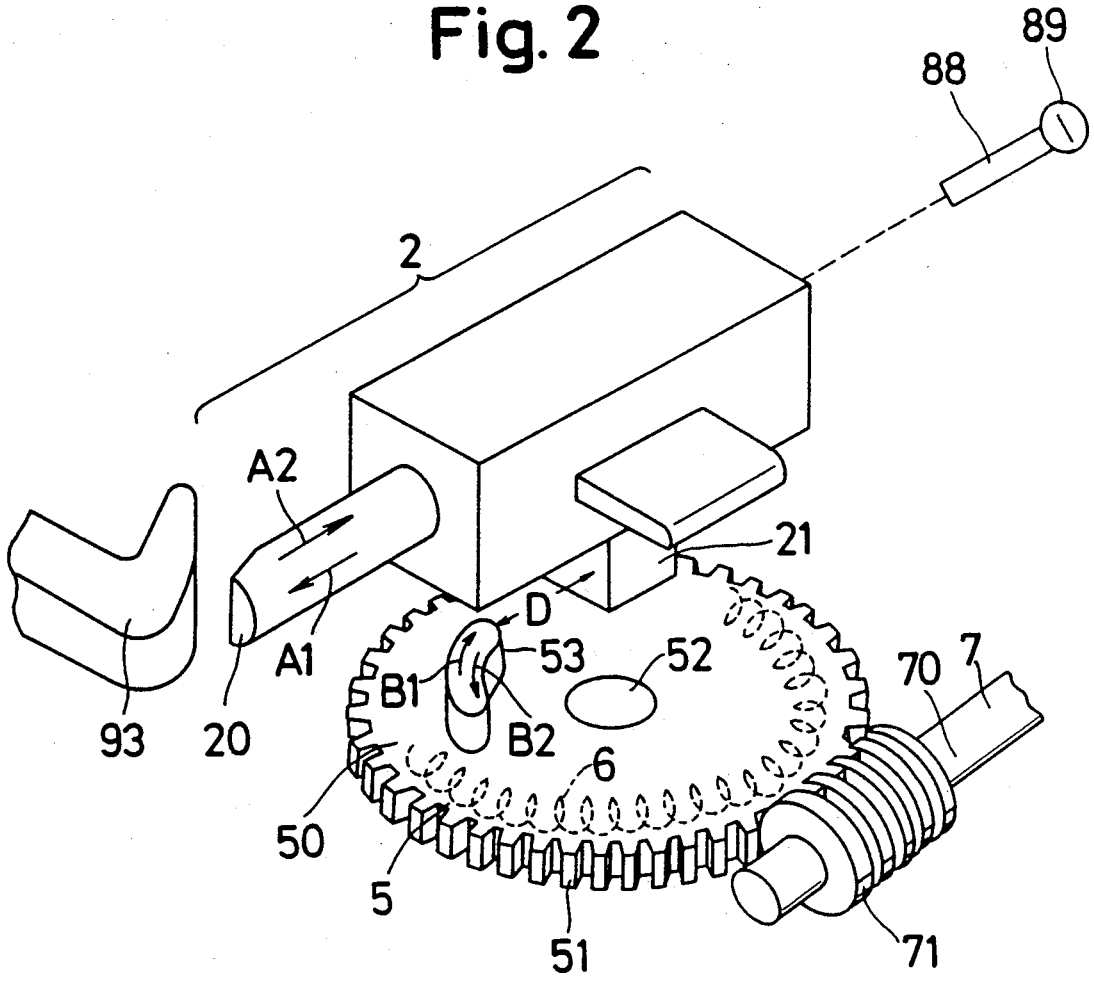
FIG. 2 is an isometric illustration of the lid locking mechanism M shown in FIG. 1.
Figure 3:
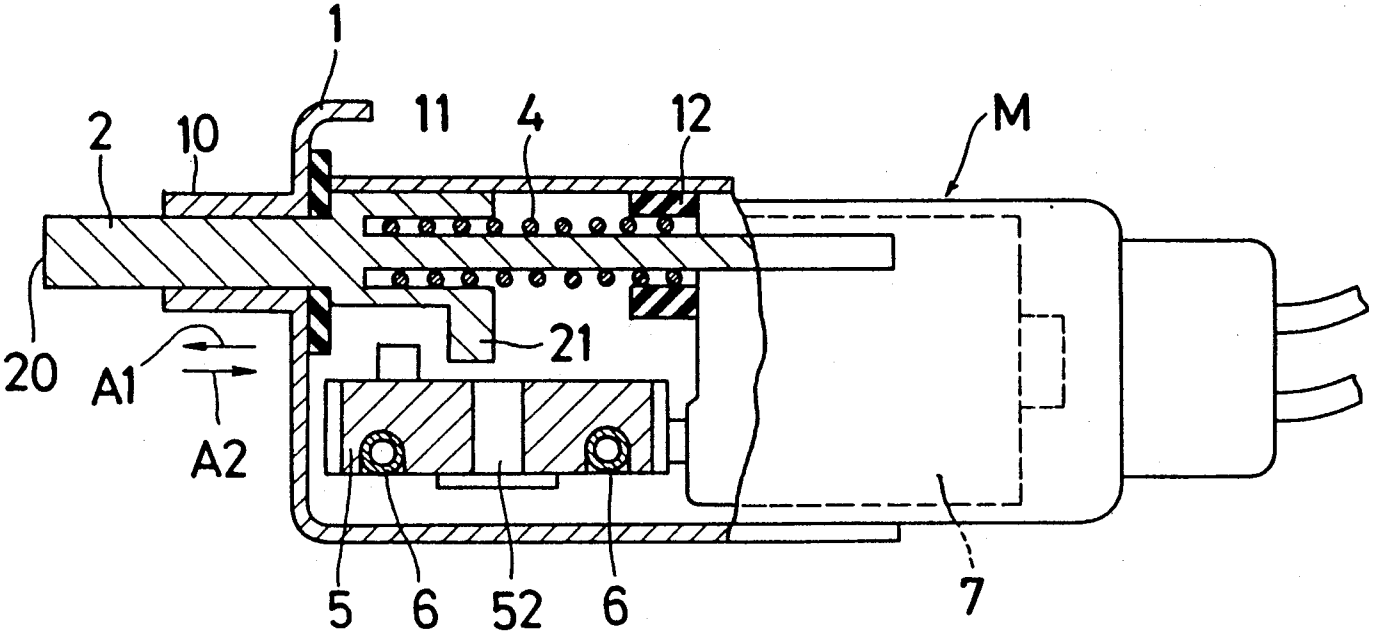
FIG. 3 is a front vertical cross-section of the mechanism shown in FIG. 2.
Figure 4:
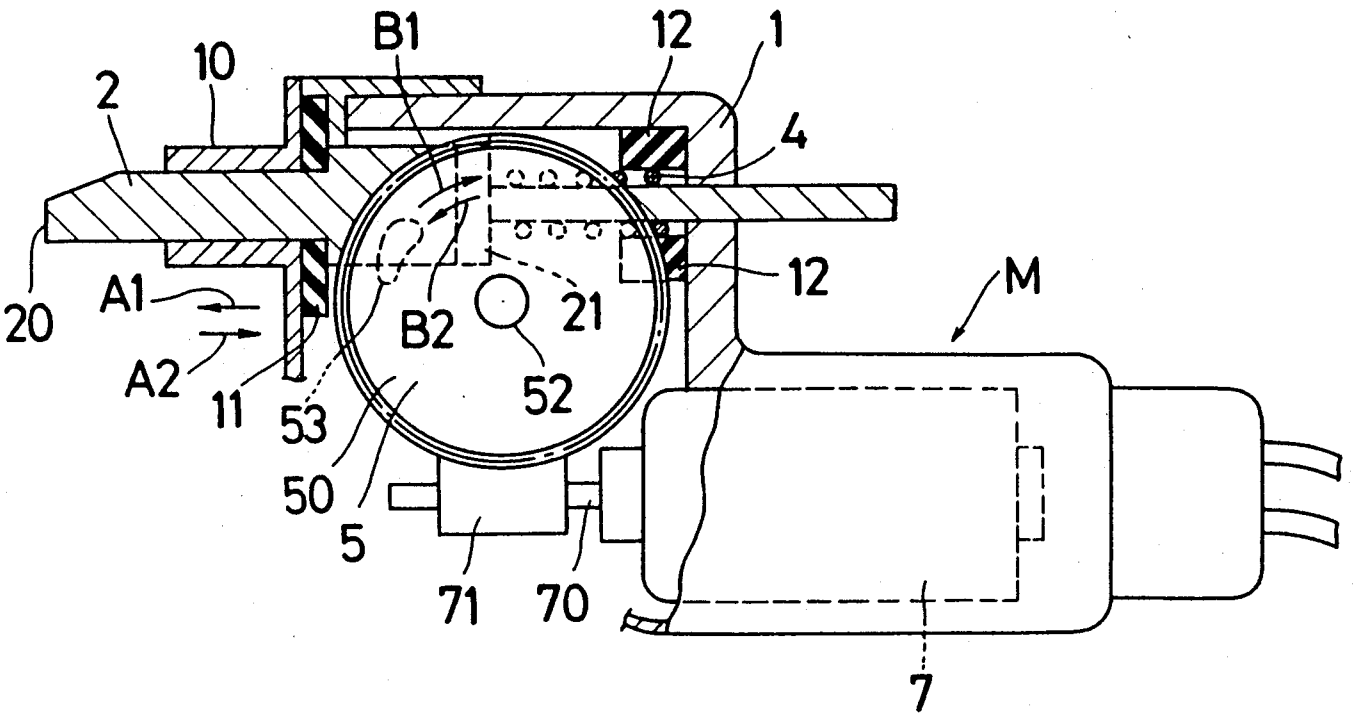
FIG. 4 is a bottom horizontal cross-section of the mechanism shown in FIG. 2.

Referring now to FIGS. 1 through 5, a vehicle body 80 is provided with an opening 81 at its rear side through which the end of a nozzle (not shown) is passed in order to supply fuel to the inlet 83 of tank 84. Lid 90 is pivotally attached to body 80 for covering opening 81. The lid 90 is held closed by pawl 93 which is engaged with end 20 of plunger 2. Upon the release of plunger 2 from pawl 93, compressed leaf spring 86 urges lid 90 to pivot outward from the body.

The locking mechanism M includes a base 1 which is secured inside body 80. Base 1 has a guide portion 10 which movably supports plunger 2 in the axial direction. The end 20 of plunger 2 engages pawl 93 when the plunger is displaced in the direction indicated by arrow A1. End 20 disengages from pawl 93 when the plunger 2 moves in the opposite direction as indicated by arrow A2. The axial displacement of plunger 2 is limited in both directions by stopper 11 and stopper 12, which are also attached to base 1.

Spring 4 is interposed between base 1 and plunger 2 so as to urge the plunger towards pawl 93. A return spring 6 is interposed between a portion of the main body 50 of worm-wheel 5 and a portion of the base 1. Worm-wheel 5 includes a main body 50 with a plurality of teeth 51 which are sometimes referred to as gears. The main body 50 of worm-wheel 5 is rotatably mounted on shaft 52. Shaft 52 is then secured to base 1. Projection 53 is formed on one surface of main body 50 in order to engage projection 21 formed on plunger 2. When plunger 2 is engaged with pawl 93, a distance D separates projection 53 from projection 21.

A motor 7, is secured to base 1 and has a shaft 70 on which worm 71 is secured. Worm 71, which is sometimes referred to as a worm gear, meshes with the teeth 51 of the worm-wheel 5.

Figure 5:
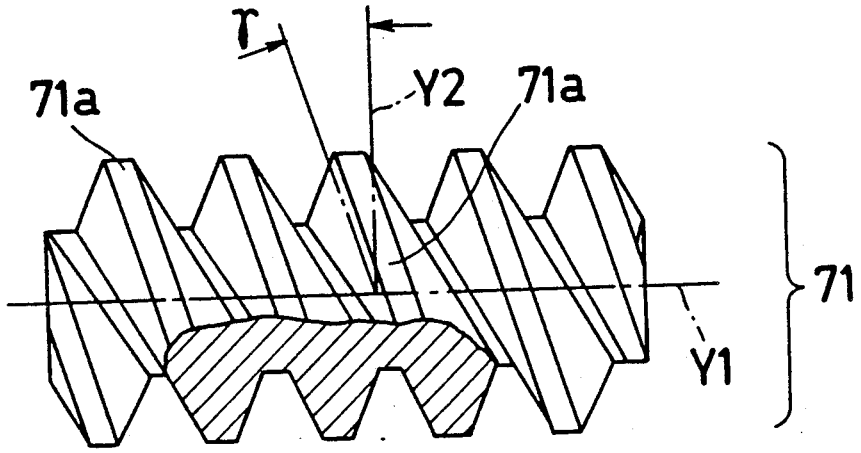
FIG. 5 is a side view of the worm illustrating its advancing angle.

FIG. 5 illustrates a side view of worm 71. The figure depicts an advancing angle $\alpha$ defined by the inclination of each tooth 71*a* relative to line Y2 which is perpendicular to axis Y1. A rotation of worm 71 will cause worm-wheel 5 to rotate for any advancing angle $\alpha$. However, worm-wheel 5 will drive worm 71 only when the advancing angle $\alpha$ is greater than a frictional angle $\phi$, where the frictional angle $\phi$ is defined by the arc tangent of the coefficient of friction between the worm 71 and the worm-wheel 5. In other words, when the advancing angle $\alpha$ is greater than the frictional angel $\phi$, rotational energy can be transmitted not only from the worm-wheel 71 to the worm 5, but also from worm 5 to worm-wheel 71.

When the worm 71 is made of phosphur bronze and worm-wheel 5 is made of a synthetic resin, the frictional angle $\phi$ may range from 0.1 to 0.15 radians. Consequently, the advancing angle $\alpha$ used with these materials must be greater than 5.71 to 8.53 degrees in order to transmit rotational energy from the worm-wheel 5 to the worm 71.

During operation, motor 7 turns shaft 70 and worm 71 so as to cause worm-wheel 5 to rotate more slowly than the shaft. As worm-wheel 5 rotates, the projection 53 from worm-wheel 5 moves about shaft 52 in the direction indicated by an arrow B1. This rotation also compresses return spring 6. As worm-wheel 5 rotates in the direction of B1, worm-wheel projection 53 approaches plunger projection 21 until they make contact. Upon making contact, plunger 2 is caused to retract in the direction indicated by arrow A2 against the urging of the spring 4. End 20 of plunger 2 then disengages from pawl 93 and moves to its unlocked position. The retraction of plunger 2 is limited by contact with stopper 12 which will also de-energize motor 7. Once in an unlocked configuration, an operator can expose opening 81 by pivoting lid 90 outward from body 80.

As worm-wheel 5 rotates in the direction of arrow B1, return spring 6 accumulates elastic energy, which is also referred to as potential energy. When motor 7 is turned off, worm-wheel 5 then rotates in the direction of arrow B2 under the urging of return spring 6 until it has returned to its original position and return spring 6 is relaxed.

Since worm-wheel 5 is disengaged from plunger 2 before the worm-wheel starts to rotate in the direction of B1, the rotational number of the motor 7 may be set during the initial rotation of worm-wheel 5. Note that the plunger 2 can also be operated by lever 88 of key-cylinder 89.

When lid 90 is once again closed, pawl 93 engages with the end 20 of the plunger 2. The force from pawl 93 causes plunger 2 to retract a slight distance against the urging of spring 4. After pawl 93 moves over the end 20 of plunger 2, the slightly retracted plunger 2 is urged back into engagement with pawl 93 by spring 4, thereby preventing outward movement of the lid 90.

The principles, preferred embodiments and modes of operation of the present invention have been described in the foregoing application. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

What is claimed is:

1. A lid locking device comprising:

a lid pivotally attached to a body for covering an opening in the body;

a pawl fixedly attached to the lid;

a base fixedly attached to the body and having a guide portion;

a plunger supported by the guide portion so as to be movable in the axial direction, said plunger having a first projection and having an end which is engagable with the pawl;

a first spring means for urging the plunger towards the pawl;

a motor having a shaft with a worm gear fixedly attached to said shaft, said motor, when actuated, transmitting rotational movement to said worm gear via said shaft;

a worm-wheel provided at a peripheral portion of the worm gear and having a plurality of teeth which are meshed with the worm gear so that rotational movement is transmitted from the worm gear to the worm-wheel so as to move the worm-wheel from an original position to a displaced position and vice versa;

a second projection projecting from the worm-wheel, said worm-wheel being rotatably mounted on the base to engage the first projection projecting from the plunger; and a second spring means for returning the worm-wheel to said original position upon disengaging the plunger from the pawl;

wherein rotational movement transmitted from the worm gear to the worm-wheel rotates said worm-wheel in a first rotational direction to the displaced position and causes the second projection to engage and move the first projection and the plunger in the axial direction, thereby disengaging the plunger from the pawl; and wherein the second spring means returns the worm-wheel to the original position by rotating said worm-wheel in a second rotational direction opposite the first direction.

2. A lid locking device according to claim 1 wherein the worm-wheel projection and the plunger projection are positioned along a common circumference and the worm-wheel projection is brought into contact with the plunger projection upon rotation of the worm-wheel.

3. A lid locking device according to claim 1 further comprising means for connecting the plunger to a key-cylinder.

4. A lid locking device according to claim 1 further comprising:

a first stopper mounted on the base so as to limit movement of the plunger in an axial direction toward the pawl; and a second stopper mounted on the base so as to limit movement of the plunger in an opposite axial direction away from the pawl.

5. A lid locking device according to claim 2 further comprising means for connecting the plunger to a key-cylinder.

6. A lid locking device according to claim 2 further comprising:

a first stopper mounted on the base so as limit movement of the plunger in an axial direction toward the pawl; and a second stopper mounted on the base so as limit movement of the plunger in an opposite axial direction away from the pawl.

7. A lid locking device according to claim 5 further comprising:

a first stopper mounted on the base so as limit movement of the plunger in an axial direction toward the pawl; and a second stopper mounted on the base so as limit movement of the plunger in an opposite axial direction away from the pawl.

8. A lid locking device according to claim 1 wherein said first spring means further comprises a wire, with two ends, coiled around said plunger, one end of the wire positioned against said base and the other end of the wire positioned against said plunger.

9. A lid locking device according to claim 1 wherein said second spring means further comprises a coiled wire with two ends, one end of the wire attached to said base and the other end of the wire attached to said worm-wheel.

10. A lid locking device according to claim 1, wherein the motor is energized to cause said worm to transmit rotational movement to said worm-wheel in said first direction, and is de-energized during rotational movement of said worm-wheel in said second direction.

11. A lid locking device comprising:

a lid pivotally attached to a body for covering an opening in the body;

a pawl fixedly attached to the lid;

a base fixedly attached to the body and having a guide portion;

a plunger supported by the guide portion so as to be movable in the axial direction, said plunger having a first projection and having an end which is engagable with the pawl in a first position;

a spring means for urging the plunger towards the pawl;

a motor having a shaft with a worm gear fixedly attached to said shaft, said motor, when actuated, transmitting rotational movement to said worm gear via said shaft;

a worm-wheel provided at a peripheral portion of the worm gear and having a plurality of teeth which are meshed with the worm gear so that rotational movement is transmitted from the worm gear to the worm-wheel so as to move the worm-wheel from an original position to a displaced position and vice versa; and a second projection projecting from the worm-wheel, said worm-wheel being rotatably mounted on the base to engage the first projection projecting from the plunger;

wherein rotational movement transmitted from the worm gear to the worm-wheel rotates said worm-wheel in a first rotational direction to the displaced position and causes the second projection to engage and move the first projection and the plunger in the axial direction from said first position to a second position, thereby disengaging the plunger from the pawl; and wherein said spring means returns said plunger to said first position after said disengagement with said pawl.

12. A lid locking device according to claim 11, wherein said device includes means for deactivating said motor when said plunger is in said second position.

13. A lid locking device according to claim 12, wherein said spring means returns said plunger to said first position from said second position after said deactivation of said motor.

14. A lid locking device according to claim 13, wherein said worm wheel rotates in a second rotational direction opposite said first rotational direction, via engagement of said first and second projections, when said spring means returns said plunger to said first position from said second position.

* * * * *